US005988861A

United States Patent [19]

Baum

[11] Patent Number: 5,988,861

[45] Date of Patent: Nov. 23, 1999

[54] SPORTS IMPLEMENT TESTING METHODS AND APPARATUS

[75] Inventor: Charles S. Baum, Traverse City, Mich.

[73] Assignee: Baum Research & Development Co., Inc., Traverse City, Mich.

[21] Appl. No.: 08/761,707

[22] Filed: Dec. 6, 1996

Related U.S. Application Data

[60] Provisional application No. 60/008,285, Dec. 6, 1995, and provisional application No. 60/030,403, Oct. 21, 1996.

[51] Int. Cl.[6] ..... A63B 59/06; G01C 23/00

[52] U.S. Cl. ..... 364/565; 73/12.02; 73/65.03; 273/317.6; 273/108.3; 33/508; 463/3; 473/219; 473/282

[58] Field of Search ..... 364/565; 73/12.07, 73/12.09, 12.11, 12.02, 65.03; 273/108.31, 108.32, 119 R, 317.2, 317.6, 108.2, 108.3; 33/508; 434/252; 463/3; 473/131, 132, 134, 138, 219, 282

[56] References Cited

U.S. PATENT DOCUMENTS

| | | | |
|---|---|---|---|
| 4,029,315 | 6/1977 | Bon | 273/55 |
| 4,070,018 | 1/1978 | Hodges | 273/29 |
| 4,309,032 | 1/1982 | Facius | 273/29 |
| 4,461,477 | 7/1984 | Stewart | 273/26 |
| 4,515,365 | 5/1985 | Horikoshi et al. | 273/25 |
| 4,563,005 | 1/1986 | Hand et al. | 273/26 |
| 4,577,863 | 3/1986 | Ito et al. | 273/26 |
| 4,583,733 | 4/1986 | Ito et al. | 273/26 |
| 4,759,219 | 7/1988 | Cobb et al. | 73/493 |
| 4,858,922 | 8/1989 | Santavaci | 273/26 |
| 4,915,384 | 4/1990 | Bear | 273/26 |
| 4,996,867 | 3/1991 | Miyamae | 73/13 |
| 5,269,177 | 12/1993 | Miggins et al. | 73/65.03 |
| 5,275,396 | 1/1994 | Sudia | 273/26 E |
| 5,375,832 | 12/1994 | Witler et al. | 273/184 R |
| 5,390,534 | 2/1995 | Feeney | 73/79 |
| 5,401,018 | 3/1995 | Kelly et al. | 273/26 |
| 5,419,549 | 5/1995 | Galloway et al. | 273/26 A |
| 5,472,205 | 12/1995 | Bouton | 273/187.1 |
| 5,478,077 | 12/1995 | Miyahara | 273/185 R |
| 5,481,355 | 1/1996 | Iijima et al. | 356/28 |
| 5,497,650 | 3/1996 | Chien | 73/12.07 |
| 5,586,940 | 12/1996 | Dosch et al. | 473/140 |
| 5,616,832 | 4/1997 | Nauck | 73/65.03 |

OTHER PUBLICATIONS

Ashley, "High Tech Up at Bat", Popular Science, May 1992.

Vizard, "Technology Comes to Bat", Popular Mechanics, Apr. 1992.

Hester et al., "Performance Measurement of Baseball Bats", pp. 7–10, Journal of the Mississippi Academy of Sciences, Aug. 1993.

*Primary Examiner*—Ellis B. Ramirez
*Assistant Examiner*—Patrick Assouad
*Attorney, Agent, or Firm*—Gifford, Krass, Groh, Sprinkle, Patmore, Anderson & Citkowski

[57] ABSTRACT

Methods and apparatus for testing a striking-type sports implement such as a bat is disclosed. In terms of apparatus, a system according to the invention includes a bat-swinging module, a ball-delivery module, and one or more programmed computers. The bat-swinging module includes means to grip a bat at its handle end, and an independent, computer servo-controlled motor to swing the bat. The ball-delivery module includes a ball support and a second, independent, computer servo-controlled motor to place the ball into the swing of the bat along a delivery path such that the bat is able to strike the ball and cause the ball to travel along a precise trajectory path. Various sensors are disposed to measure swing speed, "pitch" speed and exit velocity, with the computer(s) being operative to construct a database of bat performance characteristics based upon swing speed, pitch speed and exit velocity, and display selected portions of the database in accordance with a user input.

26 Claims, 7 Drawing Sheets

SPORTS IMPLEMENT TESTING METHODS AND APPARATUS

REFERENCE TO RELATED APPLICATIONS

This application claims priority of U.S. provisional application Ser. Nos. 60/008,285, filed Dec. 6, 1995, and 60/030,403, filed Oct. 21, 1996, the entire contents of each of which are incorporated herein by reference.

FIELD OF THE INVENTION

The present invention relates generally to sports equipment testing and, more particularly, to a system and methods for testing the performance of a striking implement such as a baseball bat or racket in conjunction with a ball or other associated projectile.

BACKGROUND OF THE INVENTION

There is an outstanding need in professional sports to quantify the performance of the equipment involved, and to provide tools to evaluate the performance of existing devices. At the present time, for example, the evaluation of bats, balls, and so forth, is almost completely dependent on the experience and observations of the players who use such equipment. These observations are supported only by an imperically derived historical database of performance statistics. Other than radar guns to measure ball velocity and video cameras for player viewing, there are no quantitative measures of ball movement(s), bat performance, etc. The need remains, therefore, for an analysis and testing system which may be used to monitor the swing of a striking type sports implement such as a bat as it strikes a ball, and to gather information as to swing speed, projectile delivery, and exit velocity. Such information may be used to create performance databases for a variety of analytical and/or statistical evaluations. When used as an input into implement manufacturing, the results obtained from the system may also be used to maximize player safety, for example, by ensuring that exit velocity does not exceed a predetermined threshold.

SUMMARY OF THE INVENTION

The present invention provides methods and apparatus for testing striking-type sports implements. Although many of the descriptions contained herein relate to baseball batting, the system is equally applicable to sports which use rackets or mallets and projectiles other than round balls. Thus, the invention may be used to test and evaluate equipment associated with softball, tennis, squash, badminton, and other sports.

Broadly, a testing process according to the invention comprises the steps of mechanically swinging the striking implement along a predetermined swing path while delivering the ball or other appropriate projectile along a predetermined delivery path and into the swing path such that it is struck and enters a flight path. As this occurs, one or more of the following are measured: the swing speed of the implement, the delivery speed of the projectile and the exit velocity of the projectile. Preferably the swing speed of the implement and the delivery speed of the projectile are measured near a point proximate to the point of striking contact, whereas exit velocity is preferably measured at a plurality of points along the flight path, not only to determine speed, but also to determine and use angular displacement along the trajectory for a more accurate reading. Based upon these measurements, a programmed computer is used to develop, compile and/or display performance characteristics, such as the ability of different implements to produce a given exit velocity as a function of projectile type, delivery speed, swing speed, and so forth.

With specific regard to baseball, a hardware embodiment of a batting machine according to the invention includes a bat-swinging module, a ball-delivery module, and one or more programmed computers. Preferably, a main computer is used for data acquisition and analysis purposes as discussed above, with a second computer being dedicated to bat-swing and ball-delivery module control, thereby offloading the main computer of tasks associated with bat and ball timing, speed and contact-point coordination.

A bat-swinging module according to the invention includes means to grip a bat at its handle end, and an electromotive source to swing the bat. A ball-delivery module may include a ball support and a different electromotive source operative to place the ball into the swing of the bat along a delivery path, enabling the bat to strike the ball and cause the ball to travel along a trajectory path. The electromotive sources are preferably implemented as computer-controlled servo motors, with the second computer being used to develop and deliver appropriate control signals to the motors to effectuate a highly accurate and predictable interaction between the bat and ball and a consistent flight path.

In a preferred arrangement, the ball delivery module includes a swing arm terminating in a fork with upper and lower members between which the ball is supported. The use of a fork shape enables the bat to swing between the upper and lower members while accurately adjusting the contact point. The ball support itself may either includes means for actively releasing the ball immediately prior to contact through the use of computer-controlled solenoid release switches. Alternatively, a break-away structure may be used which automatically releases the ball when struck. Different structures of this type are disclosed, including a two-piece arrangement having upper and lower cradles, and a one-piece unit having a central aperture within which the ball is carried. In preferred embodiments, these break-away structures are composed primarily of lightweight foam to minimize their impact on the various measurements.

A bat-swing sensor is used to output a signal carrying information associated with the swing speed of the bat. A ball-delivery speed sensor, disposed along the delivery path, is used to output a signal carrying information relating to the velocity of the ball, that is the "pitch" speed. In the preferred embodiment, a plurality of sensors are used to accurately determine exit velocity, with a first set of sensors being used to determine initial exit velocity as a function of angular displacement.

In response to an operator input, the main computer activates a hitting sequence mediated by the second computer while monitoring the signals output by the various sensors for data acquisition and analysis purposes. By selecting the sensed values indicative of the highest exit velocity, the system is able to automatically obtain accurate measurements despite slightly curved or angled trajectories, whatever the reason for such departures from a 'perfect' flight path.

The automated batting machinery and methods just described may be used in conjunction with a swing tester and an automated manufacturing process, both of which are also described herein. In the case of the swing tester, a human player is used to test a particular implement. For example, regard to baseball, a ball is positioned on a vertical, non-rigid support, with sensors on either side being used to measure bat swing and ball speed to determine a range of potential performance criteria, which may then be fed into the hitting machine for a much more refined analysis, including the ability to set more appropriate swing speeds.

In terms of automated manufacturing, as the performance characteristics are developed according to the invention, the information derived may be fed into a forming process to create an implement with specific performance range or restrictions. For example, in the case of a baseball bat, with knowledge of certain physical characteristics of the starting blank or "billet," such as material composition, size, weight, center of gravity, density, and so forth, the information obtained from the hitting machine may be input to an automated lathe or other automatically controlled formation apparatus to create a bat exhibiting a particular performance aspect or range of behavioral attributes. This input to automated manufacturing is also applicable to non-wooden, composite, and metal implements, including aluminum bats, graphite rackets, and so forth.

The combination of the swing tester, which may be used to determine a particular range of performance capabilities, the hitting machine, which may be used to analyze a highly refined set of performance criteria, and the automated manufacturing processes may be used cooperatively to form a closed loop linking the capabilities of a human player to an end product having extremely exacting performance capabilities.

DETAILED DESCRIPTION OF THE PREFERRED EMBODIMENTS

The present invention provides methods and apparatus for testing striking-type sports implements. As discussed in the Summary of the Invention, although the following description relates primarily to baseball batting, the teachings are equally applicable to sports which use rackets, mallets, or other types of striking implements, as well as objects to be struck other than round balls. Thus, the inventive concepts contained herein may be used to test and evaluate equipment associated with softball, tennis, squash, badminton, and any other sport wherein an object is struck by an implement.

Figure 1:
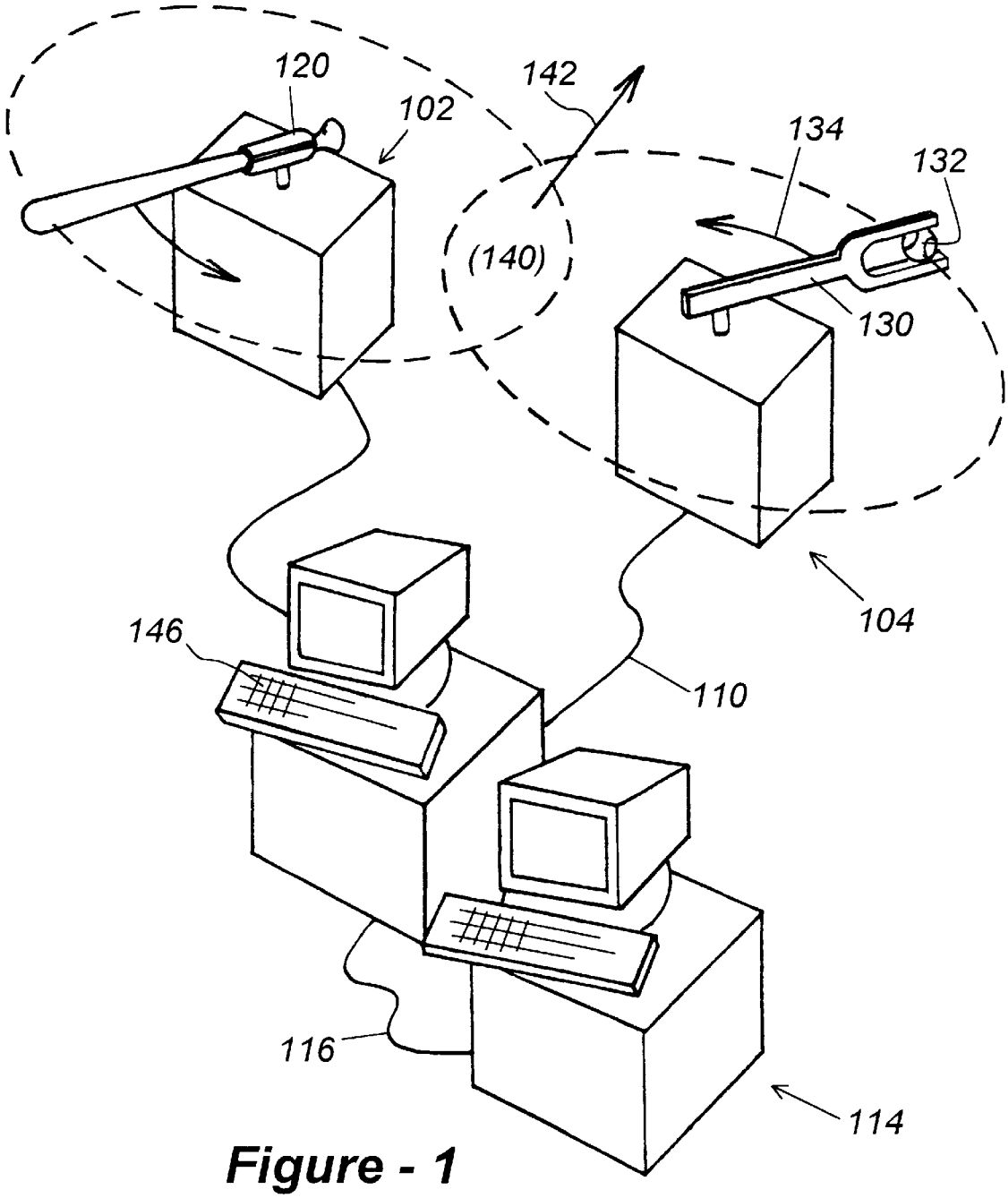
FIG. 1 is a drawing from an oblique overview depicting major modules comprising the invention.

Turning now to the drawings, FIG. 1 shows, from an oblique perspective, major components of a baseball bat hitting machine embodiment of the invention, which includes a bat-swing module 102, a ball-delivery module 104, and a movement-control computer 106 interfaced to modules 102 and 104 through communication paths 108 and 110, respectively. Interfaced to the movement-control computer 106 is a main computer 114 which communicates to computer 106 through connection 116. Although a suitably equipped multitasking type of computer may be utilized for all purposes, in the preferred embodiment the main computer 114 is used for the data acquisition and analysis functions discussed in further detail below, with movement-control computer 106 being relegated to bat-swing and ball-delivery module control, thereby off-loading the main computer of tasks associated with bat and ball timing, speed and contact-point coordination.

Figure 3:
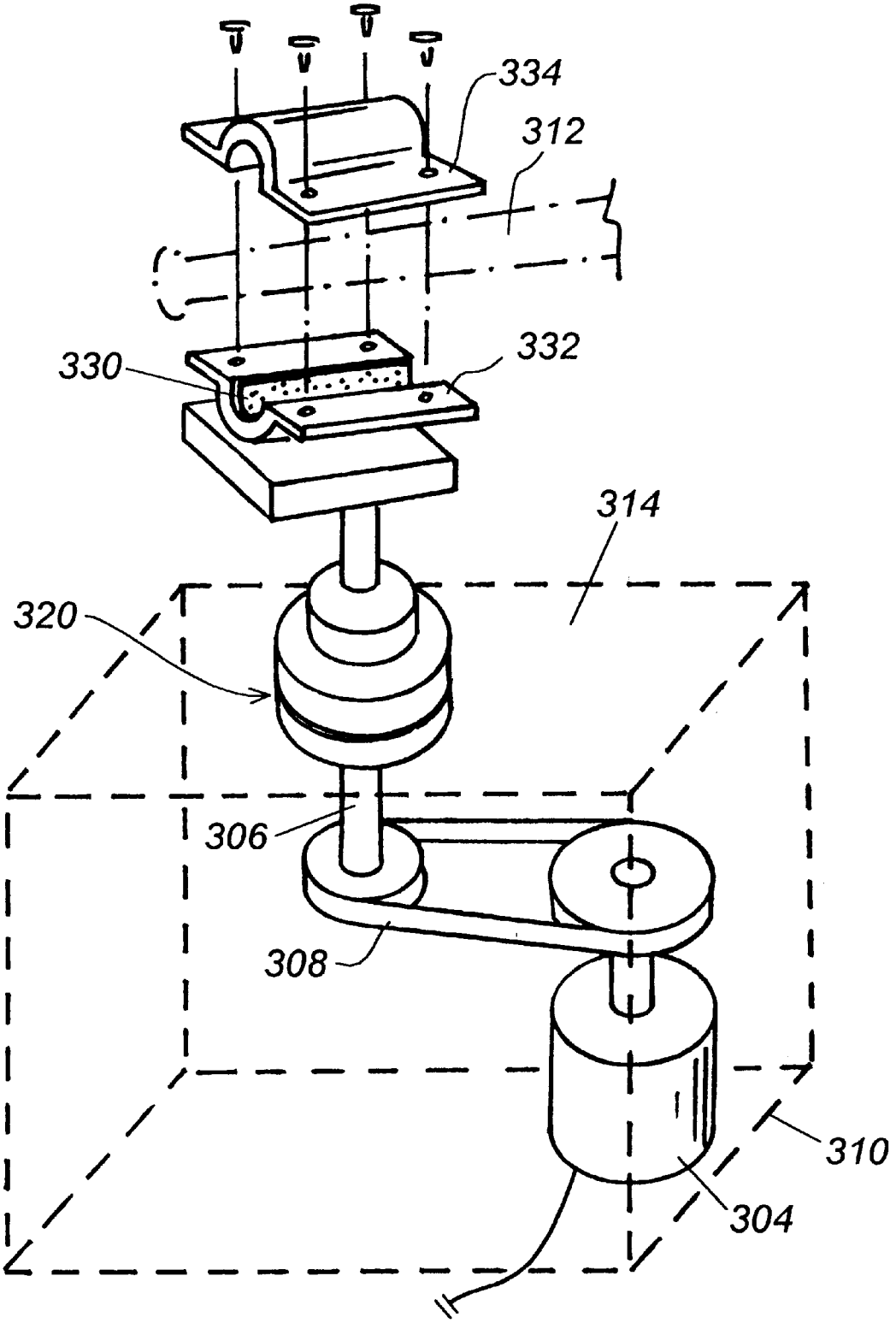
FIG. 3 is a more detailed drawing of a bat-swing module according to the invention showing a preferred motor drive and bat handle clamping arrangement.

The bat-swing module 102, which is also discussed in reference to FIG. 3, includes a source of electromotive energy (not shown in this figure), coupled to means 120 for gripping the bat 122 at its handle end, and swinging the bat, as indicated by arrow 124. Ball-delivery module 104, which is discussed again with reference to FIGS. 4, 5 and 6, includes its own source of electromotive energy (also not shown in this figure), preferably coupled to an arm 130 having a distal end 131 adapted to support a ball 132, and being operative to swing the arm and ball, as indicated by arrow 134.

According to the invention, the paths of the swinging bat 122 and that of the ball 132 are precisely controlled to create a point of striking contact, in this case, in the vicinity of area 140, causing the ball 132 to leave its support, and travel off on a flight path or trajectory, as indicated by arrow 142. Although, in the preferred embodiment, the ball is actively delivered into the swing of the bat at high speed, the system may alternatively be programmed to simply hold the ball in a stationery position in the swing path of a moving bat.

Computer systems 106 and 114 serve several purposes, some of which are not evident in FIG. 1, but which will become more apparent from the specification as a whole. Broadly, both systems include a processor, which may be of conventional design, coupled to a user input, such as keyboard 146, and means for outputting program-related information, for example, on display device 148. It will be apparent to those of skill in the art that different input and output means may be used in conjunction with the computer systems, depending upon the circumstances.

Figure 7:
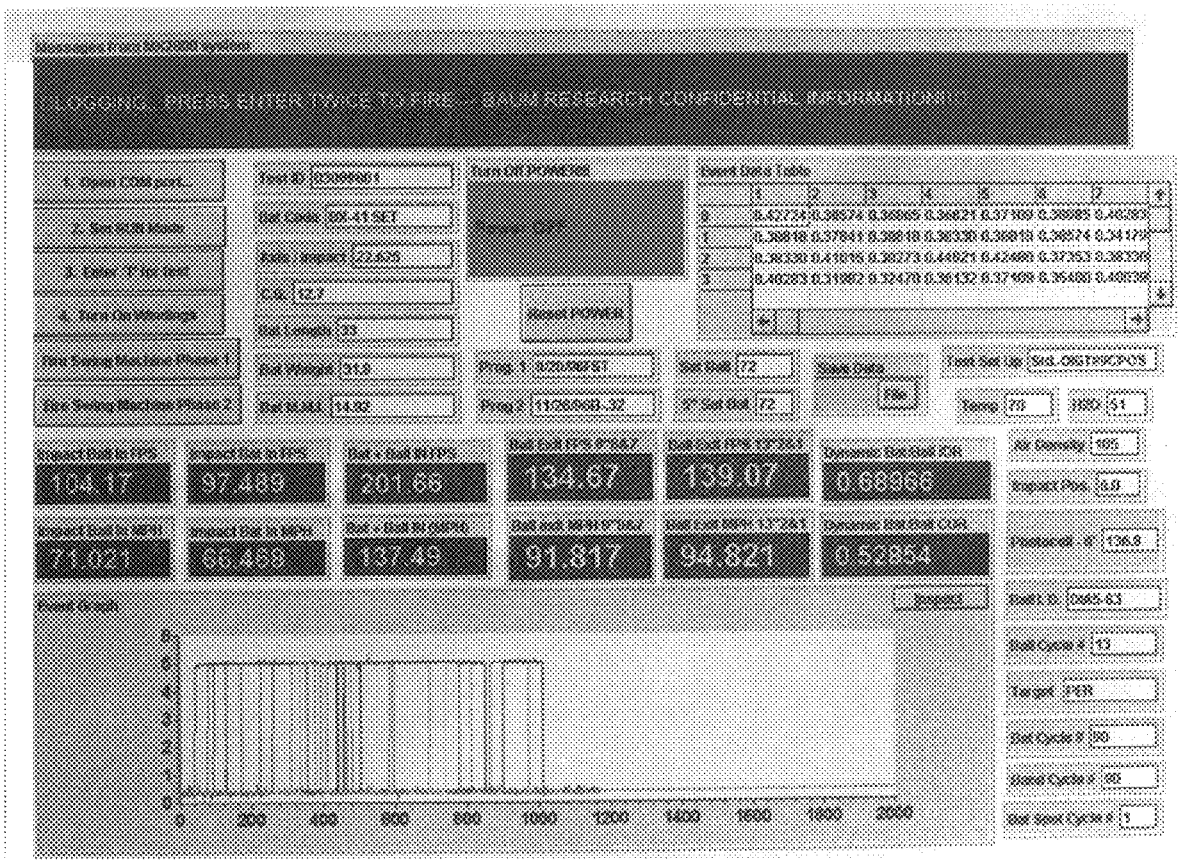
FIG. 7 is a screen display associated with a computer control aspect of the invention, illustrating some of the performance characteristics compiled for presentation on an attached display device.

Although both computer systems may be of conventional design, the hardware options of each will preferably be selected in accordance with their respective tasks, and the software programs of the two machines will be quite different. Specifically, system 106 will preferably include expansion modules and input/output interfaces associated with real-time control and, more particularly, to servomotor control, as further discussed below. The software resident on system 106 is also preferably dedicated to realtime, industrial-type control. Although such control software may be available, in part, from the manufacturer of the particular servo-motor used as the electromotive source, in the preferred embodiment, additional code, familiar to one skilled in computer programming, is provided to ensure proper coordination between the bat-swing and ball-delivery modules. In contrast, system 114 is more adapted to data acquisition and analysis, and may include expansion modules and input/output interfaces associated with sensor inputs such as analog-to-digital (A-D) converters. Additionally, the software resident on the system 114 will be more applicable to data formatting for operator interpretation and print-outs, as shown in FIG. 7.

Figure 2:
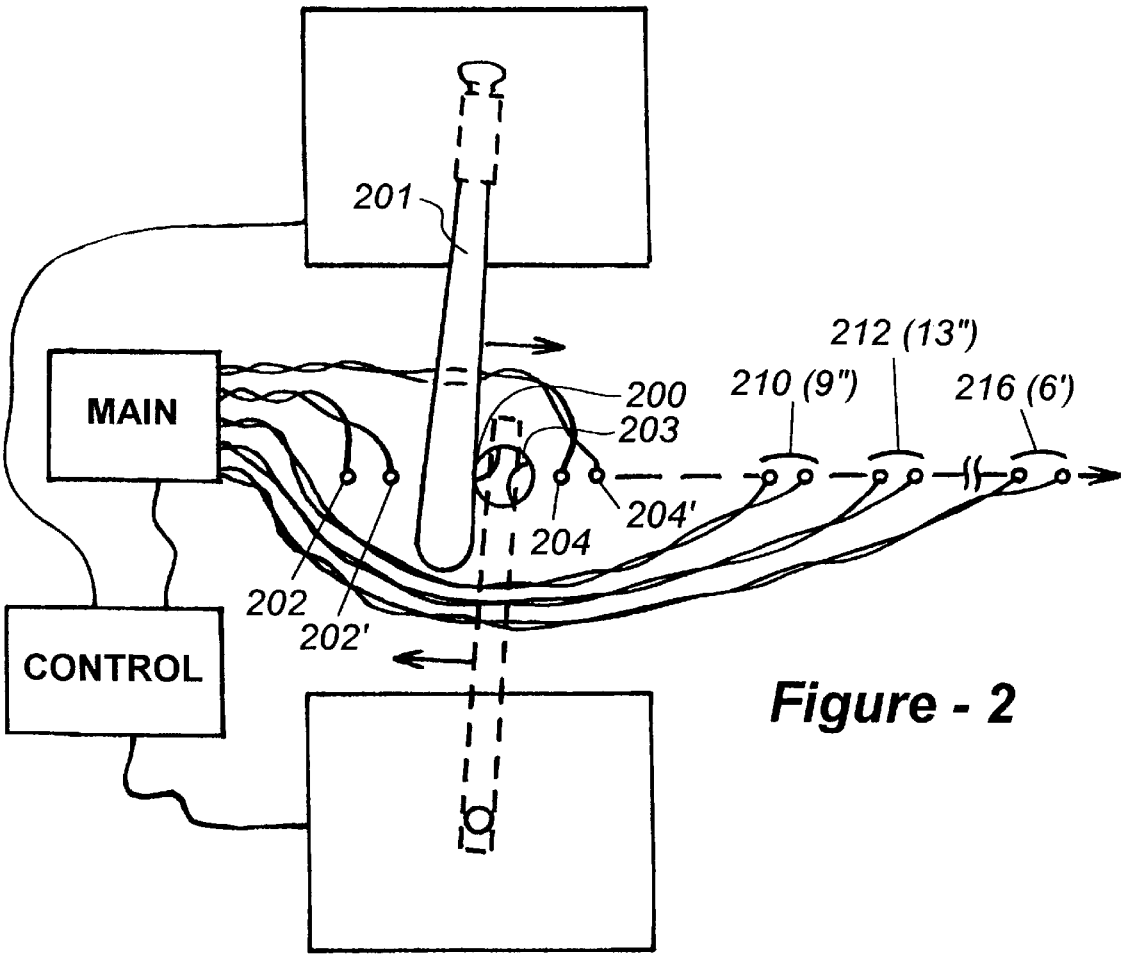
FIG. 2 is a top-view drawing of the embodiment of FIG. 1 showing the placement of various sensors to monitor bat swing and to sense ball movement(s)

Now making reference to FIG. 2, there is depicted certain aspects of the apparatus of FIG. 1, now viewed from a top-down perspective, and including other features of the invention such as bat and ball sensors to gather the performance data mentioned above. In particular, the system preferably includes a first set of optical sensor 202 and 202' located approximately one inch from the point of impact 200 to determine swing speed. A second set of optical sensors 204 and 204' are likewise provided approximately one inch from the point of impact 200 to determine the speed of the ball delivery or "pitch speed." If the width of the ball and bat are known quantities, it may be possible to use a single sensor for bat and ball speed, respectively, however, in the preferred embodiment, a pair of sensors is utilized in each case, with one being designated as a 'start' sensor and the other being designated as a 'finish' sensor. More particularly, sensors 202 and 202' in FIG. 2 constitute, respectively, the start sensor and finish sensors for the bat, whereas sensors 204' and 204 constitute, respectively, the start sensor and finish sensors associate with ball delivery.

As a further aspect of a preferred arrangement, a plurality of optical detectors are arranged along the trajectory path discussed with reference to FIG. 1, to determine the exit velocity of the ball having been struck by the bat. In particular, a first arrangement of exit velocity sensors is positioned relatively close to the point of impact, whereas a third set of sensors is placed at a somewhat more distant point along the trajectory for the following reasons. The first sets of exit-velocity sensors, which are preferably arranged at 9 inches and 13 inches along the trajectory from the point of impact, are used not only to determine exit velocity, but, in the event that one of the two sets records a faster speed, the computing means associated with the invention automatically chooses this faster velocity, knowing that angular displacement or deviation of the ball from a "perfect" light path may have been responsible for the slower measurement. Additionally, the third set of sensors 216, which are placed at approximately six feet from the point of impact, not only measure exit velocity at this point, but in addition, performs yet a further check of the first two sets of sensors both in terms of speed and angular deviation, as the case may be. Though not shown in the figures, it should be mentioned that the bat-swing and ball-delivery modules are contained within a protective cage having an aperture through which the ball exits (i.e, a 'target'), this aperture being only slightly larger than the ball itself, thus serving as yet a further indication that the ball is traveling on the correct path, that is, that the movements of the swing and delivery modules are properly coordinated by the computing means, which is preferably located outside of this protective cage for user interaction.

The various sensors are interfaced to the main and control computers along the paths illustrated in the drawing, as are the bat-swing and ball-delivery modules, as discussed above. These sensors are preferably of the type which comprise an emitter directed onto a detector defining an optical path which is broken by the bat, or ball, as the case may be. The various emitter/detector pairs may either be activated continuously (or cycled at a rapid rate), such that, by monitoring the amount of time that a particular path is interrupted, the computer 220 may calculate swing speed, bat movement, and so forth, in a relatively straightforward manner apparent to one of skill in the art of microprocessor-type system design. In terms of geometrical configuration, the emitter may be placed above or below the area through which the bat or ball is expected to travel, with the detector being placed oppositely such that the path is broken by virtue of the movement being monitored. Side-to-side arrangements are also possible, depending upon the circumstances.

As a further option, sensors may be added to determine bat and/or ball vibration, with the signals from such sensors being used to determine further performance characteristics such as "sweet spot." These vibrations sensors are preferably implemented as accelerometer-type sensors, as described in co-pending U.S. application Ser. No. 08/717,549, the entire contents of which is also incorporated herein by reference. Whereas the bat vibration sensor(s) may be supported directly onto or within the bat and hard-wired to the computer for analysis, the ball sensor(s) are preferably installed along with an RF transmitter to permit a wireless communication. The ball sensor(s) may either be embedded within the ball or, since the point of impact is well known, may be placed on the backside of the ball elsewhere to avoid a direct hit by the bat.

FIG. 3 is an oblique representation of a bat-swing module which better illustrates certain features of this aspect of the invention. In particular, in a preferred embodiment, the electromotive source utilized to swing the bat is provided in the form of a servomotor 304, which is coupled to a vertical shaft 306 through some form of mechanical coupling, whether in the form of a gear, chain or pulley 308, as shown. In alternative embodiments, the drive means may be coupled directly to the vertical shaft 306, depending upon the particular mechanical capabilities of the drive unit chosen. The shaft 306 preferably emerges through a top panel 314 of an enclosure 310 through a series of bearings 320, which also assist in stabilizing bat movement, as coupled through the drive means.

At the top end of the rotating shaft 306, means are provided for gripping a bat at its handle end. Preferably, this grip takes the form of a padded cradle 330 which is attached to a base 332 which is, in turn, coupled to the upper end of the shaft 306. A clamping element 334 is provided which, when brought down in mating agreement with cradle 330, grasps the bat at its handle end to make possible a rigidly coupled swing without excessive slippage, but with an impact comparable to that delivered by a human batter. Note that by moving the bat along its longitudinal axis with the clamp loosened, the mechanism may be tightened to simulate the position of the batter's hands at various points along The bat, including "choked-up" positions.

Figure 4:
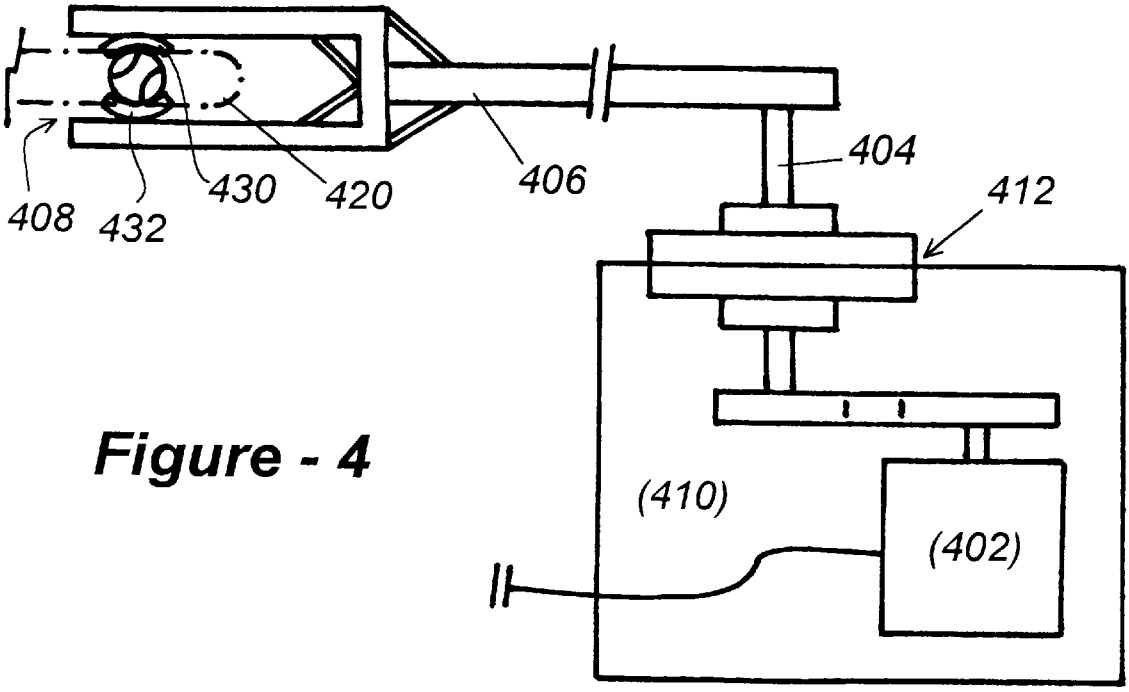
FIG. 4 is a more detailed drawing of a ball-delivery module according to the invention.

Turning now to FIG. 4, there is shown, from a side and cross-sectional perspective, a ball-delivery module according to the invention. As with the bat-swing module of FIG. 3, a separately computer-controlled servo motor 402 is used in a preferred embodiment to provide electromotive power for ball delivery, this motor 402 being coupled to a vertical shaft 404 which, in turn, is joined to a swing arm 406 having a distal, ball-supporting end, 408. Also, as with the bat-swing module, the electromotive source and coupling of the source to shaft 404 is preferably contained within an enclosure 410, with the shaft 404 emerging through the enclosure through a set of bearings 412 to provide overall stability.

The distal end 408 of the arm 406 preferably takes on a fork-like configuration, having upper and lower members spaced apart by a distance on the order of five or six inches or more. This fork-like configuration serves as to two purposes, first, as evident from FIGS. 2, 4, 5 and 6, the arrangement enables the end of the bat to swing between the upper and lower members when striking the ball, which affords a convenient mechanism by which the point of contact may be adjusted. In addition, the fork-like configuration at the distal end of the ball-delivery swing arm is used to accommodate the ball-release mechanisms described below.

These ball-release devices may either be "active" or "passive" according to the invention. The active mechanisms use upper and lower electromechanical components such as electric solenoids which automatically retract immediately prior to contact with the ball, with the computer system described in further detail below being responsible for coordinating such release to ensure that it occurs on the order of a millisecond prior to the moment of contact.

Figure 5:
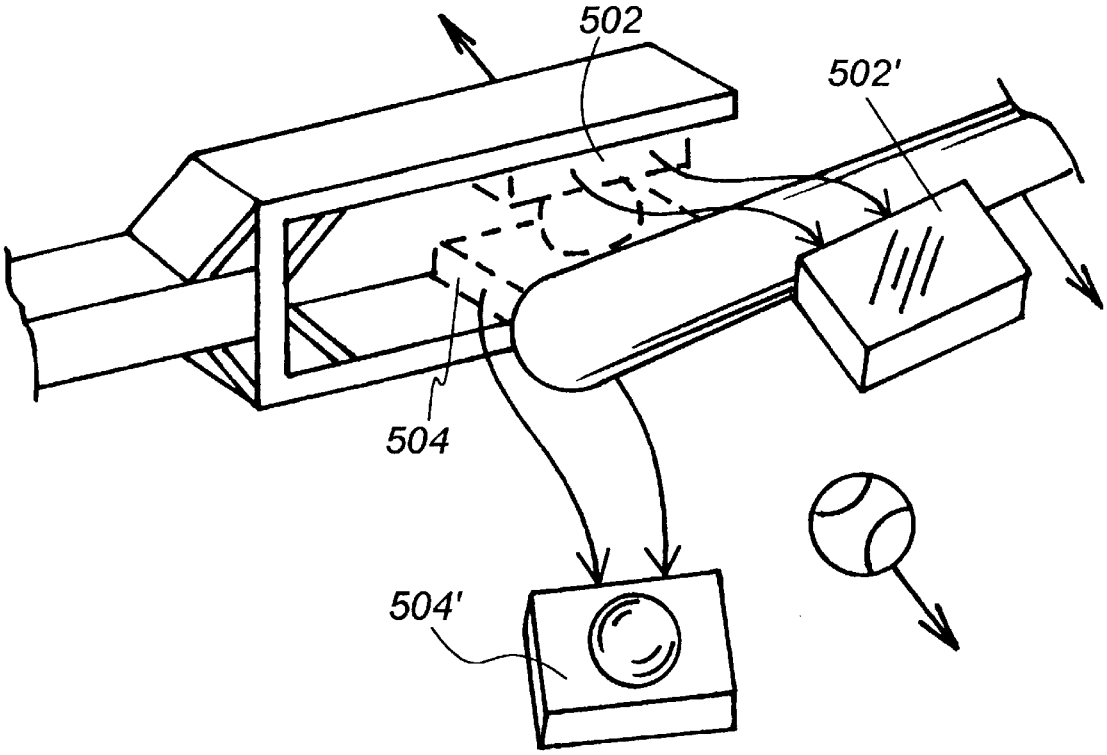
FIG. 5 is an oblique view drawing illustrating the break-away action of a ball support according to the invention.

In a preferred embodiment, however, the invention utilizes a passive break-away type structure which automatically releases the ball upon impact. One such structure is illustrated in FIG. 5, which shows a pair of upper and lower lightweight shells 502 and 504, respectively. Preferably composed of foam, these shells 502 and 504 leave exposed the girth of the ball 506 to be struck in an unimpeded fashion by the bat, while readily falling away upon impact, as indicated by shells 502' and 504' in the drawing.

Figure 6:
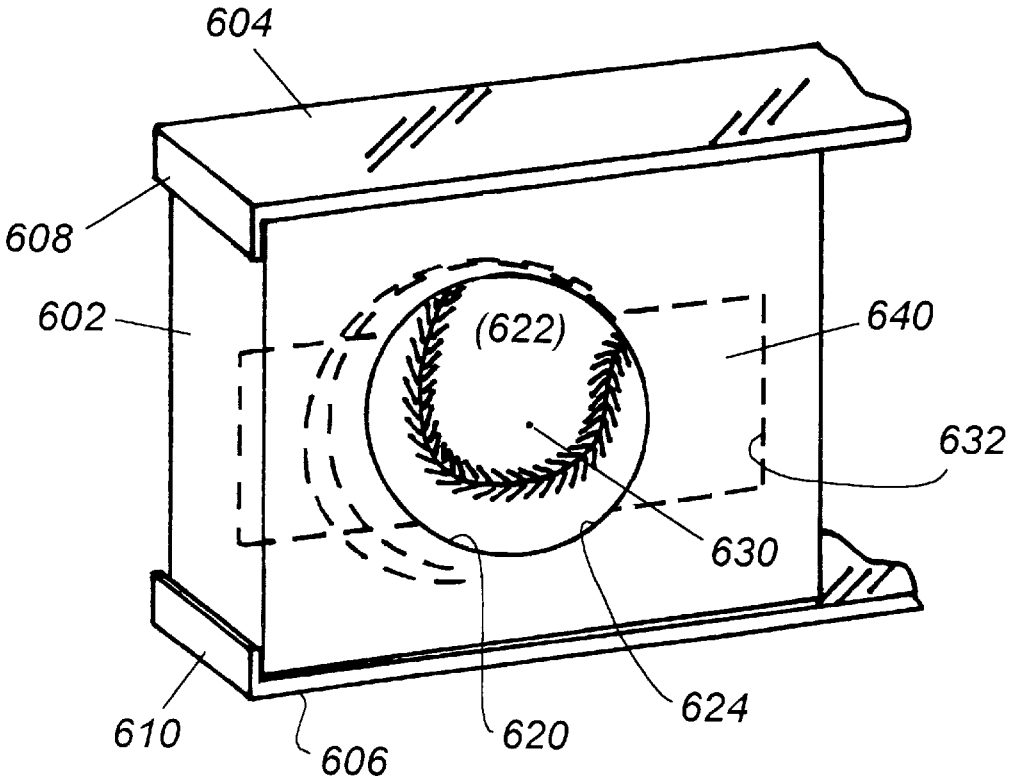
FIG. 6 is an oblique view drawing illustrating the break-away action of an alternative, preferred ball support.

FIG. 6 is an oblique view drawing illustrating an alternative breakaway type of ball support which, in fact, is used in a preferred embodiment. In place of the two-part structure of FIG. 5, a single apertured block 602 is used which, again, is preferably composed of a lightweight foam material. This block 602 is held between the upper member 604 and lower member 606 of the swing-arm assembly of the ball-delivery module, with stops 608 and 610 being used to contain the block 602 as the arm swings. The block 602 preferably includes a more or less centralized aperture 620 within which the ball 622 rests. Preferably, the aperture 620 is made slightly larger than the diameter of the ball 622, with a small plastic spacer member 624 being used to ensure a snug fit of the ball 622 against the inner wall of the aperture 620 and against a sheet of adhesive material 640 (i.e, tape), preferably placed flush against the backside of the block 602.

With the ball supported in this way the point of contact 630 is sufficiently pronounced relative to the surface 632 of the block 602 that, upon impact, the bat strikes the ball in advance of the block material, enabling the ball to be ejected by the block and enter an exit trajectory in a substantially unimpeded fashion, with the block 602 trailing far behind, with little negative impact. The adhesive properties and tensile strength of the tape 640 are carefully selected so as to carry the supported ball through a controlled swing, yet readily give way upon impact.

Figure 8:
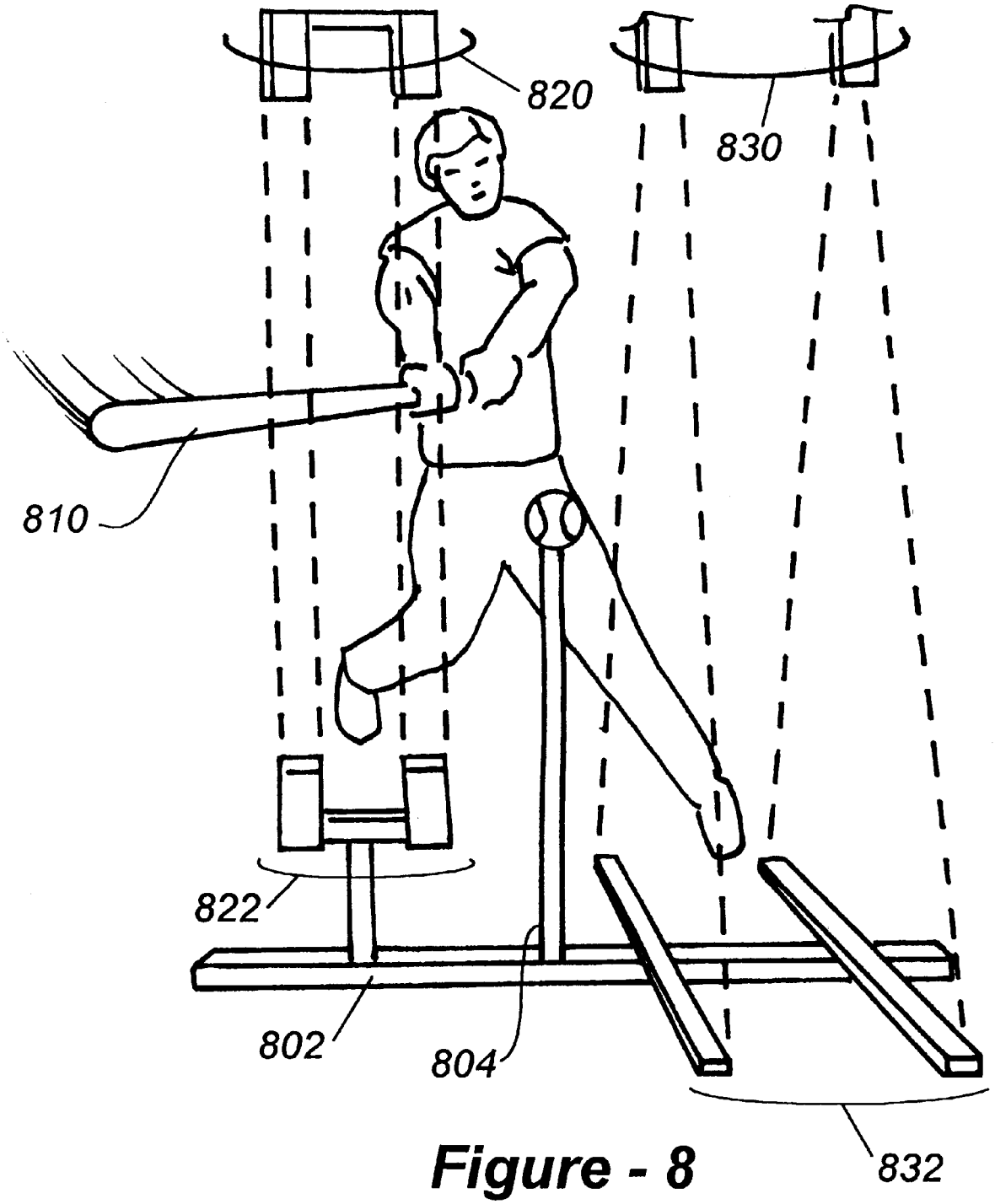
FIG. 8 is a front-view drawing of a swing tester according to a different aspect of the invention.

As an adjunct to this invention, a swing tester apparatus depicted in FIG. 8 may be used in conjunction with a human batter 806 to provide a range of performance characteristics such as actual swing speed as a function of bat weight, length, center of gravity, and so forth. These characteristics may be gathered prior to the automated testing of the equipment involved, thereby allowing the settings of the hitting machine to be that much more directed, refined, and/or practical for a particular range of performance.

Continuing the reference to FIG. 8, the swing tester preferably includes a lower frame 802 upon which there is disposed a vertical support 804 upon which the ball 805 rests, an element commonly referred to as a "tee." This tee 804 is sufficiently rigid to hold the ball in a desired configuration, but not so rigid as to interfere with the swinging movements of the batter 806. Accordingly, the tee may be comprised of a non-rigid or somewhat flexible accordion-type of member.

A first set of emitters 820 and detectors 822 are used to determine the swing velocity of the bat 810, and a second set of emitters 830 and detectors 832 are used to obtain at least a rough approximation of exit velocity, given the characteristics of the bat 810 and, to some extent, the characteristics of the ball 805. Note that, whereas the emitters and detectors 820 and 822 may form vertical lines which are broken by the bat, in a preferred embodiment of the swing tester the light from emitters 830 fans out to bar-shaped detectors 832, preferably transverse to the path of trajectory, enabling an accurate determination of exit velocity to be calculated despite the angular deviation of the ball 805 as it leaves the top of the pedestal 804.

Figure 9:
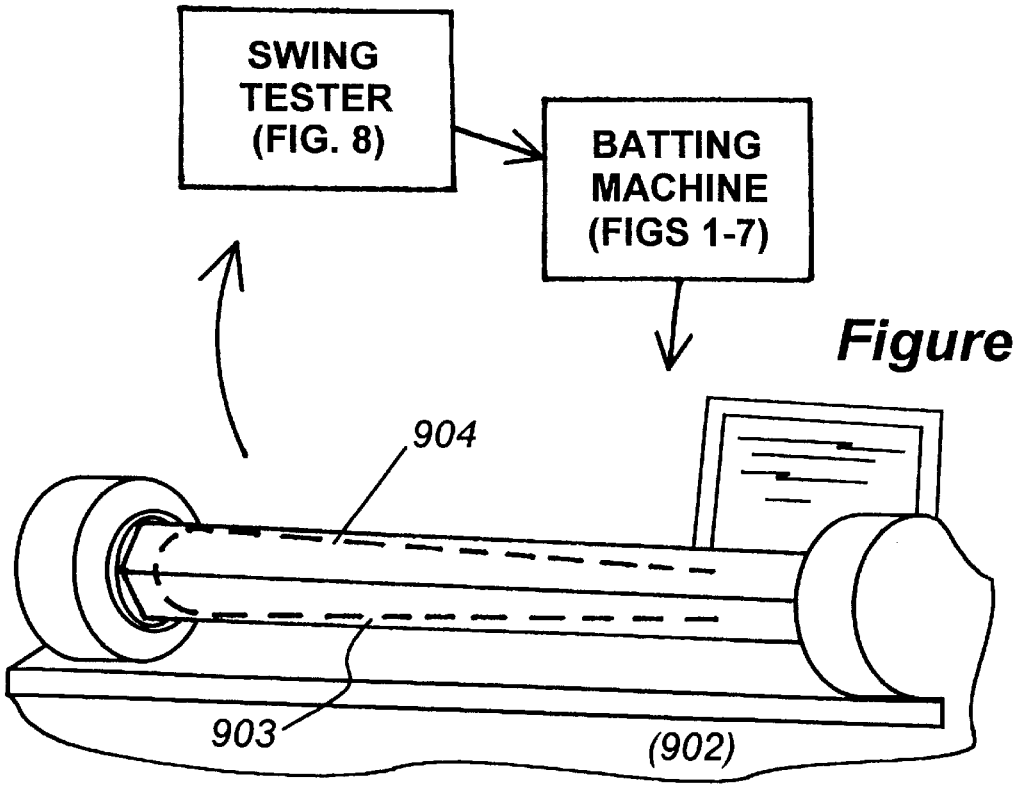
FIG. 9 is a schematic drawing of a feedback loop made possible by information extracted through the invention to establish an automated manufacturing process to realize an implement with particularized performance characteristics.

FIG. 9 shows how the hitting machine depicted in FIGS. 1–7, and the swing tester of FIG. 8 may be used in conjunction with a computer numerically controlled (CNC) lathe 902 or other automated formation or modification system to produce a striking-type sports implement such as bat 903 (shown in broken-line form), in this case, from a starting billet of wood 904. Given the comprehensive performance data made possible by the hitting machine, and knowing the physical characteristics of the billet 904, such as center of gravity, density, and/or density per unit of length, by measuring a similar implement, and recording its performance characteristics at a number of contact points along its length, this information may be fed into the CNC lathe 902, to create a bat 903 having a desired set of performance characteristics. For example any given set of physical criteria may be used to achieve a desired target center of gravity. Moreover, this capability may not only be used to ensure that a particular implement for its maximum performance for a given weight, length, or cross-sectional aspect, but may also be used to limit performance, for example, to ensure that exit velocity will also be below a certain amount for a given object being struck, thereby contributing to player safety.

Having produced an implement in this fashion, it may then be given to a human for testing, for example, using the swing tester of FIG. 8 in the case of a baseball bat. In the event that the bat produced with CNC lathe 902 exhibits performance characteristics which deviate from those desirable, the output of swing tester may be fed to hitting machine, and again to the lathe, in closed-loop fashion, until a particular characteristic or range of performance features is ultimately realized.

That which is claimed is:

1. A sports-related testing system, comprising:

an implement movement module, including means to grip the implement and a first electromotive source to move the implement in a predetermined path;

an implement movement sensor outputting a signal relating to the movement of implement;

an object delivery module, including an object support and a second electromotive source operative to place the object into the path of the implement along a delivery path such that the implement is able to strike the object, causing it to travel along a flight path;

a delivery speed sensor disposed along the delivery path outputting a signal relating to the velocity of the object upon delivery;

an object speed sensor disposed along the flight path outputting a signal relating to the exit velocity of the object; and programmed computer means including a user input, a display, and interfaces to the first and second electromotive sources and to the sensors, the programmed computer means being operative to perform the following functions:

(a) activate the first and second electromotive sources in response to the user input so that the implement strikes the object, causing the object to enter the flight path, (b) construct a database of performance characteristics associated with at least the implement based upon the signals output by the various sensors, and (c) display selected portions of the database in accordance with the user input.

2. The sports-related testing system of claim 1, wherein the implement is a bat and the object is a ball.

3. The sports-related testing system of claim 1, wherein the electromotive sources are computer-controlled servo motors.

4. The sports-related testing system of claim 1, wherein the computer means includes the following two programmed computers in communication with one another:

a main computer interfaced to the sensors and used primarily for data acquisition and management, and a control computer interfaced to the electromotive sources and used primarily to coordinate the timing and speed of the implement movement module and object delivery module.

5. The sports-related testing system of claim 1, including a plurality of object speed sensors disposed along the flight path, each outputting a signal relating to the exit velocity of the object, with the computer means being further operative to analyze the outputs of each object speed sensor to determine exit velocity as a function of angular displacement.

6. An automated ball hitting machine, comprising:

a bat-swinging module, including means to grip the bat at its handle end and a first electromotive source to swing the bat through a predetermined swing path;

a bat-swing sensor outputting a signal associated with the swing of the bat;

a ball-delivery module, including a ball support and a second electromotive source operative to place the ball into the swing path of the bat along a predetermined ball delivery path such that the bat is able to strike the ball and cause the ball to travel along a trajectory;

a delivery-speed sensor disposed along the ball delivery path outputting a signal relating to the velocity of the ball upon delivery;

a ball-speed sensor disposed along the trajectory outputting a signal relating to the exit velocity of the ball; and programmed computer means including a user input, a display, and interfaces to the first and second electromotive sources and to the sensors, the programmed computer means being operative to perform the following functions:

(a) activate the first and second electromotive sources in response to the user input so that the bat strikes the ball, causing the ball to enter the flight path, (b) construct a database of performance characteristics associated with at least the bat based upon the signals output by the various sensors, and (c) display selected portions of the database in accordance with the user input.

7. The automated hitting machine of claim 6, wherein the electromotive sources are computer-controlled servo motors.

8. The automated hitting machine of claim 6, wherein the computer means includes the following two programmed computers in communication with one another:

a main computer interfaced to the sensors and used primarily for data acquisition and management, and a control computer interfaced to the electromotive sources and used primarily to coordinate the timing and speed of the bat-swinging module and ball-delivery module.

9. The automated hitting machine of claim 6, including a plurality of ball speed sensors disposed along the trajectory, each sensor outputting a signal relating to the exit velocity of the object, with the computer means being further operative to analyze the outputs of each object speed sensor to determine exit velocity as a function of angular displacement.

10. The automated hitting machine of claim 6, wherein the ball support includes means for actively releasing the ball immediately prior to the striking of the ball by the bat.

11. The automated hitting machine of claim 6, wherein the ball support includes a break-away structure which automatically releases the ball when the ball is struck by the bat.

12. The automated hitting machine of claim 11, wherein the break-away structure includes a cradle within which the ball is supported.

13. The automated hitting machine of claim 12, including a cradle composed of lightweight foam.

14. The automated hitting machine of claim 6, including means for adjusting the point at which the bat strikes the ball.

15. The automated hitting machine of claim 14, wherein the means for adjusting the point at which the ball strikes the bat includes:

a ball-delivery module having a fork-shaped distal end with upper and lower members between which the ball is supported, enabling the bat to swing between the two members.

16. A baseball bat test system, comprising:

a bat-swinging module, including means to grip the bat at its handle end and a first motor drive to swing the bat in a swing plane;

a bat-swing sensor disposed in the swing plane outputting a signal relating to swing speed;

a ball-delivery module including a pivoted swing arm and a second motor drive operative to rotate the swing arm in a path which intersects the swing plane of the bat so that the bat hits the ball at a point of striking contact, causing the ball to leave the support and travel along a trajectory;

a ball-delivery sensor disposed along the path of the swing arm outputting a signal relating to pitch speed;

a ball-speed sensor disposed along the trajectory outputting a signal relating to the exit velocity of the ball; and programmed computer means including a user input, a display, and interfaces to the motor drives and to the sensors, the programmed computer means being operative to perform the following functions:

(a) activate the motor drives in response to the user input so that the bat hits that ball and causes it to enter the trajectory, (b) construct a database of bat performance characteristics based upon swing speed, pitch speed and exit velocity, and (c) display selected portions of the database in accordance with the user input.

17. The baseball bat test system of claim 16, wherein the swing of the bat and the path of the ball-supporting swing arm are counter-rotational in the same general horizontal plane.

18. The baseball bat test system of claim 16, wherein the swing arm of the ball-delivery module includes a forked distal end having upper and lower members between which the ball is supported and through which the bat swings to strike the ball.

19. The baseball bat test system of claim 18, wherein the ball is supported with means for actively releasing the ball immediately prior to the striking of the ball by the bat.

20. The baseball bat test system of claim 18, wherein the ball is supported in a lightweight cradle which automatically releases the ball when the ball is struck by the bat.

21. The baseball bat test system of claim 16, wherein the computer means includes the following two programmed computers in communication with one another:

a main computer interfaced to the sensors and used primarily for data acquisition and management, and a control computer used primarily to coordinate the timing and speed of the servo motors.

22. The baseball bat test system of claim 16, including a plurality of ball speed sensors disposed along the trajectory, each outputting a signal relating to exit velocity, with the computer means being further operative to analyze the outputs of each sensor to determine exit velocity as a function of angular displacement.

23. A testing method for sporting goods, comprising the steps of:

mechanically swinging a sports implement along a swing path;

mechanically delivering an object to be struck by the implement along a delivery path and into the swing path such that the object is struck at a point of contact, thereby entering a flight path;

measuring the swing speed of the implement at a point proximate to the point of contact;

measuring the exit velocity of the object along at least one point of the flight path; and determining a performance characteristic as a function of swing speed and the exit velocity.

24. The method of claim 23, further including the steps of:

measuring the speed of object delivery at a point proximate to the point of contact; and determining the performance characteristic as a function of swing speed, object delivery, and the exit velocity.

25. The method of claim 23, wherein the implement is a bat and the object is a ball.

26. The method of claim 23, further including the step of measuring the speed of the object at a plurality of points along the flight path to determine angular deviation of the ball.

* * * * *